US005694787A

United States Patent [19]

Cleleand et al.

[11] Patent Number: 5,694,787

[45] Date of Patent: Dec. 9, 1997

[54] COUNTER TOP BEER CHILLING DISPENSING TOWER

[76] Inventors: Robert K. Cleleand, 11051 Via El Mercado, Los Alamitos, Calif. 90720; James M. Cleleand, 4200 Vie Norte St., Cypress, Calif. 90630

[21] Appl. No.: 593,347

[22] Filed: Jan. 29, 1996

[51] Int. Cl.[6] ..... B67D 5/62

[52] U.S. Cl. ..... 62/396; 62/390; 165/168

[58] Field of Search ..... 62/389, 390, 393, 62/394, 396, 398, 399, 400; 165/168, 169; 222/129.1, 146.6

[56] References Cited

U.S. PATENT DOCUMENTS

| | | | |
|---|---|---|---|
| 2,612,357 | 9/1952 | Parks | 62/390 |
| 2,814,184 | 11/1957 | Johnson | 62/390 |
| 5,524,452 | 6/1996 | Hassell et al. | 62/389 |

*Primary Examiner*—John M. Sollecito
*Attorney, Agent, or Firm*—Georges A. Maxwell

[57] ABSTRACT

A counter top beer dispensing tower structure including a thermo insulating jacket structure with a top wall, a flat counter top engaging bottom wall, rear and side walls, a flat vertically and laterally extending front wall and a body insulating material at the inner surfaces of the walls, a metal cold plate within the body of insulating material, a plurality of laterally spaced dispensing valve mounting parts carried by and projecting forwardly from the plate and accessible at the front wall, a plurality of elongate tubular beer conducting coils in the plate, each beer conducting coil has a downstream end portion connected with a related valve mounting part and a vertical upstream end portion depending from the plate and bottom wall to extend through a primary opening in a related counter and to connect with the downstream end on of related beer conducting line, and elongate tubular glycol coil unit within the plate and having vertical upstream and downstream end portions depending from the plate and the jacket structure to extend through the primary opening in the related counter and to connect with downstream and upstream ends of related delivery and return sections of an elongate glycol conducting lines a glycol chiller and, plurality of spaced apart elongate vertically extending threaded mounting studs anchored to and depending from tower jacket structure to extend through secondary openings in the related counter; and, nuts on the studs and engaging the counter to draw the bottom wall in to tight engagement with the top of the counter.

18 Claims, 6 Drawing Sheets

T
J
13
14
V
2
12
11
V
10
B
17
2
15
16
91
83
90
20
C

14
P
P
T
11
J
10
12
15
13
17
B
F
S'
60
S
G-B
C
61
16
18
61
25
19
64
63
90
20
91
83
90

T
14
V
J
12
V
13
10
16
17
B
C
63
60
63
64
F
60
83
91
20
90
21
84
85
86
87
88
82
81
80
80
83

COUNTER TOP BEER CHILLING DISPENSING TOWER

BACKGROUND OF THE INVENTION

The present invention resides in the art of beverage handling and dispensing systems and apparatus and is particularly concerned with an improved system and apparatus for handling and dispensing chilled beer. More particularly, the invention has to do with the handling and dispensing of beer from kegs through dispensing valves that are located remove from the kegs, and a system that functions to chill the beer to a low temperature as it flows to and through the dispensing valves.

The great majority of beer dispensing systems and apparatus in bars, taverns and other commercial establishment in which beer is sold and dispensed; kegs of beer are stored in refrigerated cold rooms that are provided to store perishable foods and beverages at reduced temperatures. The mean temperature in cold rooms, during normal working periods, is about 40° F. Accordingly the temperature of beer in the kegs stored in such rooms is about and for the purpose of this disclosure will be said to be at 40° F. The beer is dispensed from manually operable dispensing valves at the upper end portions of Beer dispensing towers that are mounted atop serving counters that are positioned remote from the cold rooms. In practice, the towers are from the cold rooms as little as 15 to as much as 200 feet. The beer is conducted from the kegs in the cold rooms to the towers through plastic tubes or beer lines that are arranged to extend longitudinally through thermally insulated jacket structures called "trunk lines".

In practice, the kegs are suitably charged with motive gas that drives the beer therefrom, through the beer lines and to the valves at the towers.

Except in those few systems where the beer lines extending from the kegs in the cold rooms to the valves at the towers is less than about 20 feet, the ordinary beer dispensing system includes refrigerated glycol chillers that are located within or adjacent to the cold rooms and that include elongate glycol re-circulating lines of plastic tubing that extends longitudinally of the beer lines within the trunk lines and the ends of which are connected with a heat exchange device. The glycol chillers include motor driven pumps that function to continuously circulate chilled glycol through the glycol lines.

It is important to note that the plastic tubing of which the beer lines and glycol lines are established and the glycol solution are very poor conductors of heat and that the circulating of chilled glycol, as noted above only works to slow the rate at which beer flowing through the beer lines heats. It does not affect chilling of the beer flowing through the beer lines. In practice the circulation of chilled glycol through 75 feet of trunk line might be expected to let the beer entering the upstream end of the trunk lines at 40° F. to warm to 42° F. or 43° F. by the time it reaches the downstream end of the trunk line. Without circulating chilled glycol through the trunk line as noted above, the beer is likely to warm to near 47° F. or 48° F.

It is to be noted that in practice the trunk lines are arranged to extend longitudinally through counter top supporting cabinetry and that their downstream ends terminate in spaced relationship beneath the counter tops, where the towers are mounted. The beer flowing through the beer lines is conducted from the beer lines at the downstream ends of the trunk lines to the valves at the upper end portions of the towers through elongate balance lines and then through stainless steel delivering tubes that extend down from the dispensing valves, through the tower structure, through the counter tops where they are connected with the balance lines. In practice the beer flowing from the beer lines, through the noted balance lines and stainless steel tubes can be expected to warm from 2° F. to 4° F. Thus, in the example given above, beer entering the trunk lines at 40° F. is warmed to 43° F. at the downstream end of the trunk lines and is furthered warmed to, for example, 45° F. or 46° F. by the time it reaches the dispensing valves.

An important characteristic of beer resides in the fact that the carbon dioxide gas entrain therein is quit stable and is not subject to escaping from the liquor of the beer and to thereby generate appreciable amounts of foam when it is chilled to 29° F. or 30° F. As the temperature of beer is increased to above 30° F. the gas becomes increasingly unstable and generates foam at an ever increasing rate when dispensed or otherwise disturbes. When beer is warmed to 45° F. (or more) the gas becomes so unstable and so much foam is generated when it is dispensed through valves that it often cannot be economically dispensed. This occurs when the cost of beer that is poured to waste in the form of foam is equal to or greater then the profit that must be made through the sell of that beer which has been converted to foam.

In accordance with the above, the profits to be realized from the sale and dispensing of beer is most often directly related to the amount of foam that is poured off to waste in the form of foam, which is directly related to the temperature of the beer, at the dispensing valves. When the beer is chilled to about 30° F., close to 100% of potential profits realized. However, when the beer is let to warm to, for example, 45° F. it is likely that excess foam will have to be poured to waste and economic lose will be experienced.

In the recent past the prior art has resorted to the inclusion of heat exchangers in beer dispensing systems to chill beer to a low temperature at the down stream ends of the trunk lines. The heat exchangers are thermally Jacketed cast aluminum cold plates within which stainless steel, tubular, beer conducting coils extend. The beer coils have upstream ends that are connected with the beer lines extending through the trunk lines and downstream ends that are connected with the upstream ends of the balance lines that deliver beer to the stainless steel beer delivery tubes of the tower structures.

The cold plates next include tubular glycol re-circulating coils with upstream and downstream ends that are connected with the downstream and upstream ends of upstream and downstream sections or legs of the glycol recirculating lines, at the downstream of the trunk lines.

In the above noted cold plate type heat exchangers the chilled glycol circulating through the plates carries heat from the plates and from the beer that is circulated through the plates. If the glycol is chilled to, for example 30° F., where it enters the cold plates it can be expected that the beer flowing substantially continuously through and from the plates will be chilled and exit the plates at about 31° F. In such a case if the beer warms 4° F. as it is conducted to the dispensing valves tubes it will be dispersed at about 35° F. When dispensing beer at 35° F., if particular care and skill is not exercised, sufficient foam is likely to be generated and poured to waste so that a substantial portion of the potential profits from the sale of that beer are lost.

A major short-coming in the provision and use of cold plates of the nature and character noted above resides in the fact that they must be mounted below their related counters in as close proximity to the lower ends of the delivery tubes as is practical. This often requires that the cabinetry that customarily occurs below and supports the counters be worked upon and modified to accommodate the cold plates. It also requires that valuable storage space that the cabinetry was intended to provide be sacrificed to accommodate the cold plates.

In addition to the foregoing, in the great majority of cases a multiplicity of different makes and brands of beer are sold and dispensed at most beer serving counters. Each beer is normally dispensed from a dispensing valve at the upper end portion of a tower structure that is provided for it. Accordingly, if four brands of beer are to be dispensed there will be a series or line of four spaced apart tower structures, one for each brand of beer, mounted atop the counter. The tower structure are typically about 6" wide at their bases and are spaced apart 3". In such a case, the lower downstream ends of the delivery tubes of the four towers are spaced apart 6" throughout a distance of 24". In such the balance lines that connect the several delivery tubes to the downstream ends of the a case beer conducting coils of the cold plates are splayed or spread out beneath the counter. The foregoing results in a tangle of tubes and in additional warming of the beer as it is transported from the cold plates to the dispensing valves carried by the towers.

In addition to the foregoing it is rare that a catch basin or Drip tray is not mounted in the counters adjacent towers to occur below the dispensing valve thereof, to catch and affect disposal of beer that is spilled and foam that must be poured off to waste. The basins are connected with suitable plumbing that is located within cabinetry beneath the counters. These basins and their related plumbing often prevent the most affective positioning and mounting of cold plates beneath the counters where the towers are mounted and require that the plates be located and mounted at one side or the other of the row or line of towers and basins. In such cases, the balance lines that connect the beer conducting coils to the stainless steel tubes of the towers are extended as circumstances require and notably greater warming of the beer is likely to occur as it is transported from the cold plates to the dispensing valves.

It is an extremely important and little recognized and/or appreciated fact that when beer is warmed the bubbles of gas entrain therein expand at a great and rapid rate and the expanding bubble of gas combine, as they expand, to make ever increasing larger bubbles. As this process starts the gas becomes excited to a state where the process can be said to feed upon itself and causes the gas to be, quite unstable, though its temperature is such that the gas would otherwise be quite stable. When this condition occurs, if the temperature of the beer is stabilized and it let to rest, the large bubbles of gas will disburse within and be reabsorbed by the liquor.

As a result of the foregoing, in those beer dispensing systems with cold plate type heat changers such as described above, when the beer is let to warm as it flows from the cold plates to the dispensing valves; when the valves are open to dispense the warming beer, highly excited and unstable gas will often separate from beer and sputter and blast out of the valves, blasting the liquid about and causing excess foam to be generated, in spite of the fact that the temperature of the beer is quite low and such that the gas therein should be quit stable.

Certain person in the prior an have noted that the dispensing valves of beer dispensing systems are exposed to the ambient atmosphere and are warmed thereby to a temperature that is greater then the temperature of the beer that is delivered to them. Further, they have noted that when the beer delivered to the valves is let to rest in the valves (between the dispensing of servings of beer) it is warmed by the valves and that gases therein expand and separate from the liquor. The heat introduced into the beer by the valves migrate back into the beer delivery tubes of the tower structures to cause expansion and separation of gas from the beer in those tubes. As a result of the above, when the valves are opened, the free-gas within the valves and downstream thereof blast from the valves and the gas remaining in the in beer flowing through the valves become so excited that it continues to separate from the liquor and blasts out of the valves. As a result of the foregoing, those person have provided special vane chilling means to chill the valves to temperatures that are lower than the temperature of the beer delivered to them such and that beer is let to rest in the valves it is not let to warm to a temperature greater then the temperature of the beer delivered to them and the gas therein remains stable.

The above noted dispensing valve chilling means have included metal blocks positioned within the upper end portions of dispensing towers adjacent to the dispensing valves and through which chilled glycol is circulated to carry heat away from the blocks and from the valves. While such chilling means are effected to chill their related valves they are essentially unrelated to and are inoperative to chill or to any way alter the temperature of the beer that is delivered to the valves to be dispensed thereby.

It has been observed that in those systems in which the above noted valve chilling means are provided; when the valves are periodically opened an ounce or two of beer that has been chilled within the valve to a temperature slightly below the temperature of the beer delivered to the valves might be first emitted from the valves; and, that the temperature of the beer that follows is unchanged. That is; after an initial minor squirt of chilled beer is dispensed the beer that follows from the valves it is at essentially the same temperature as is the beer that is conducted to the valves.

OBJECTS AND FEATURES OF THE INVENTION

It is an object of our invention to provide an improved vertically extending beer dispensing tower structure to be mounted atop a related beer dispensing counter and that carries or includes a plurality of beer dispensing valves for selectively dispensing different brands of beer and that includes a cold plate heat exchanger of cast metal, carring on elongate tubular beer coil for each valve having a metal valve connecting part at its downstream end in which a portion of its related valve is engaged in heat transfer engagement therewith each coil has a downstream end portion that extends down through and below a related counter to connect with a downstream end of a related line delivery line; an a elongate tubular glycol coil is in the plate and has upstream and downstream end portions that extend downwardly through and below the counter to connect with delivery and return sections of a glycol recirculating line of a glycol chiller machine thermo insulating jacket structure is engaged about the plate. Spaced apart threaded studs carried by and depending from the tower structure and are engageable through a related counter; and, nut and washer assemblies engageable with the studs and with a bottom surface of a related counter to releaseably secure the tower structure atop the counter.

It is another object and a feature of the invention to provide a tower structure of the general character referred to above wherein chilled glycol circulated through the glycol coil carries away heat from the plate, from the beer coils and from the beer flowing there through; and, chills the dispensing valves so that beer is not let to warm before it moves by the valving members within the valves and such that gas in the beer is not allowed to become thermally excited and unstable downstream of or within the valves.

Yet another object and a feature of the invention is to provide a novel beer dispensing tower structure of the general character referred to above wherein the cast metal plate has a depending post through which the upstream end portions of the beer coils and the upstream and downstream end portions of the glycol coil extend and depend and about which a thermally insulated jacket structure can be engaged whereby the portions of the coils that depend through and from below a related counter are within an integral part of the plate and a related thermo insulated jacket structure; and, such that a single opening need be established in a related counter to accommodate the extension, to affect connecting of the several coils with their related lines below the counter.

It is a further object and a feature of the present invention to provide a novel tower structure of the general character referred to above wherein the studs to secure the tower atop a related counter are carried by the ther jacket structure below and in thermally insulated relationship from the plate so that the studs and their related screw fastener parts do not conduct heat to the plate and are not chilled by the plate and thereby act as condensers that might otherwise produce potentially deleterious free water beneath their related counters.

Finally it is an object of the invention to provide a novel beer dispensing tower structure that more affectively and efficiently chills and dispenses beer than those prior art systems and apparatus of which we are aware; a tower structure for chilling and dispensing beer that can be manufactured, installed and maintained at costs that are notably less than is the cost to manufacture, install and maintain prior art beer chilling and dispensing apparatus that include cold plate heat exchanging means; and, a tower structure including a cold plate heat exchanger that does not require modifying or rebuilding cabinetry to accommodate it or that requires the sacrifice of storage space or the like to accommodate it.

The foregoing and other objects and features of the invention will be apparent and will be fully understood from the following detailed description of preferred embodiments of the invention throughout which description reference is made to the accompanying drawings.

DETAILED DESCRIPTION OF THE INVENTION

Figure 1:
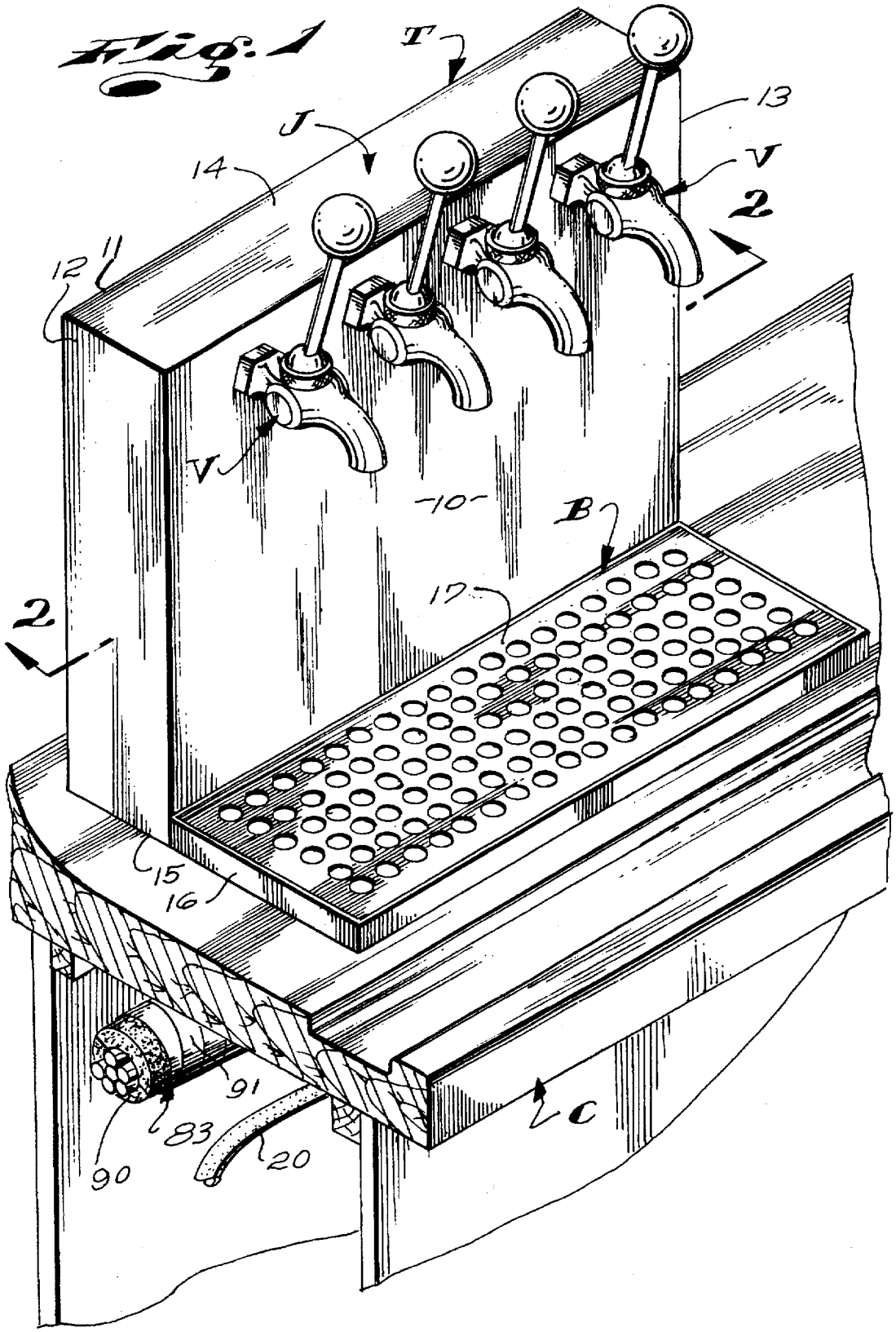
FIG. 1 is an isometric view of a beer dispensing tower structure embodying our invention.

In FIG. 1 of the drawings, we have shown our new beer dispensing tower structure T. The tower structure T is shown mounted atop a counter C. The tower T is shown as a flat, vertical, rectalinear unit with flat vertical front and rear walls 10 and 11, flat vertical, oppositely disposed side walls 12 and flat horizontal top and bottom walls 14 and 15. The several noted walls are panel-like exterior walls of a thermo insulating jacket structure J.

The jacket structure J next includes a body of cellular foam thermal insulating material that extend across and throughout the inside infuces of the walls thereof.

In the preferred embodiment of our invention the noted exterior walls are established of metal.

The outside dimensions of the portion of the tower structure shown in FIG. 1 are about 5" (front to back) about 18" long (side to side) and about 16" high (top to bottom).

The tower is shown as including 4 manually operable beer dispensing valves V. The valves V are arranged in lateral spaced relationship across the upper portion of the front wall and project freely forwardly therefrom.

As shown and in accordance with common practice a common basin B is engaged atop the counter C adjacent the front of the tower. The basin B is shown as including an upwardly opening rectangular pan 16 of stainless steel and as having a perforated grate 17 set therein. The pan is about ¾" deep. The pan has a central depending drain tube 18 that is engaged through an opening 19 in the counter C and that connects with a drain tube 20. The drain tube 20 extends to a drain pipe 21. The bottom wall of the pan is preferably bounded to the top service of the counter with a sealing compound. The basin is preferably equal in lateral extent with the tower and in practice measures about 7" from front to back.

In practice, if desired other forms of basins can be used in combination with our new tower without in any way departing from the broader aspects and spared of our invention.

FIGS. 2 through 6 of the drawings illustrate certain details of construction of our new tower T. For the purpose of best illustrating the nature and character of our invention the proportioning of parts and the arrangement thereof have been altered. For example, in FIG. 2, the lateral extent of the tower has been reduced relative to the height thereof; and the position of the valve parts is at variance with the preferred positioning thereof. Further the radiuses of the bends of tubular coils has been increased and the number of legs of the coils, extending between the radius portions thereof, has been reduced so as not to unnecessarily crowd and complicate the drawings.

Within the jacket structure J is a rectangular cast metal cold plate M. The cold plate M is preferably made of aluminum or aluminum alloy. The plate M has flat front, rear, side and bottom surfaces 10', 11', 12', 13', 14', and 15' that are in parallel spaced relationship from the walls 10, 11, 12, 13, 14, and 15 of the jacket structure. The space between the noted related walls and surfaced is approximately 1" and is totally filled and occupied by the foam plastic insulating material I.

The body of foam insulating material I is hard foam plastic that is foamed and cured in the space it occupies. It intimately bonds to the surfaces it contacts; is structurally sound and strong; and, it does not permit the entry or the condensation of moisture in the structure that might otherwise result in degradation thereof.

Within the cast metal plate M are four elongate tubular serpentine formed stainless steel beer conducting coils B, each to conduct beer to a related one of the valves V.

The coils B are, for example, established of 5/16" ID stainless steel tubing and are about 15 feet long.

Each of the coils B has a downstream end portion that terminates in the upper end portion of the plate where it connects with a related elongate forwardly opening, internally threaded valve mounting part P. Each part P has a rear end portion that is anchored within the plate and forward portion that project forwardly from the front surface of the plate and terminate within a related opening in the front wall 10 of the jacket structure J. Each parts P threadedly receives the threaded nipple or stem of a related valves V, as clearly shown on FIG. 5 of the drawings.

The other or upstream end portions of the beer coils B are turned downwardly and extend through a stem S of cast metal formed intrigantly with the plate M and that depends from the bottom surface 15 thereof a sufficient distance to extend through the jacket structure, an opening 25 in the counter C and appropriate distance below the counter C to allow convenient engagement of insulating material about it.

In practice, the stem S extends beer through a length of stainless steel tube S and the space between the stem and the tubing is filled with the insulating foam.

In practice, the tube S, is circular in cross-section and has an outside diameter and corresponds with the inside diameter of the opening 25 established in the counter C.

The lower end portions of the beer coils can depend from the lower end of the stem S a sufficient distance to allow for some bending thereof and are preferably formed with barbs or carry barb coupling sleeves to facilitate their being effectively engaged within related downstream ends of plastic beer lines.

The cold plate M next includes a glycol recirculating coil unit G. The unit G is shown as including transversely extending upstream and downstream manifold 50 and 51 in the lower portion of the plate and five elongate einuate formed tubular glycol coils 53 with upstream and downstream ends that are connected with their related upstream and downstream manifolds 50 and 51 and that extend un parallel contact with the beer coils 50, as clearly shown in FIGS. 4 and 5 of the drawings.

Figure 2:
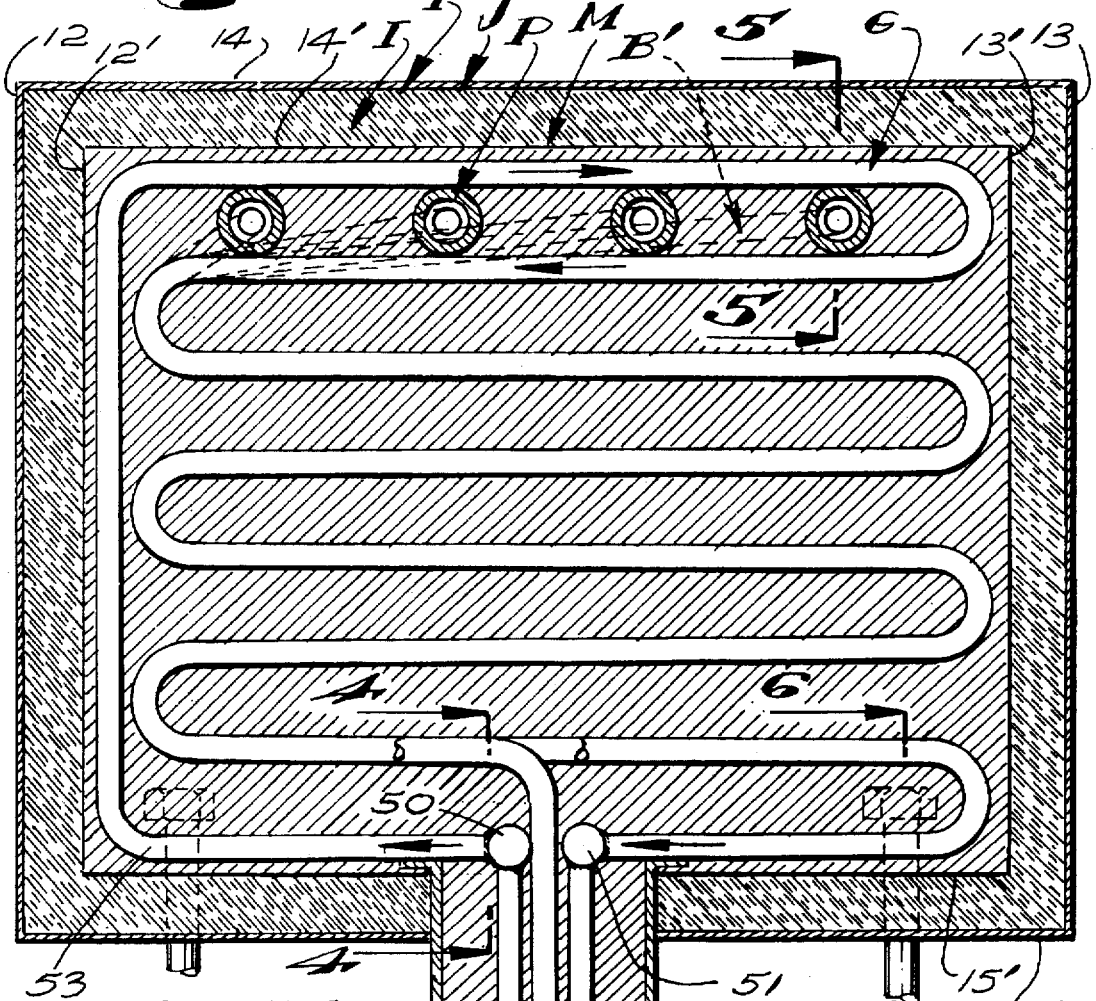
FIG. 2 is a sectional view of the tower structure taken substantially as indicated by line 2.2. on FIG. 1.
Figure 3:
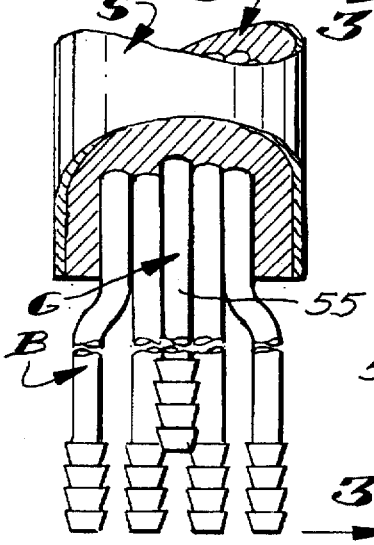
FIG. 3 is a sectional view taken substantially as indicated by line 3—3 on FIG. 2.
Figure 4:
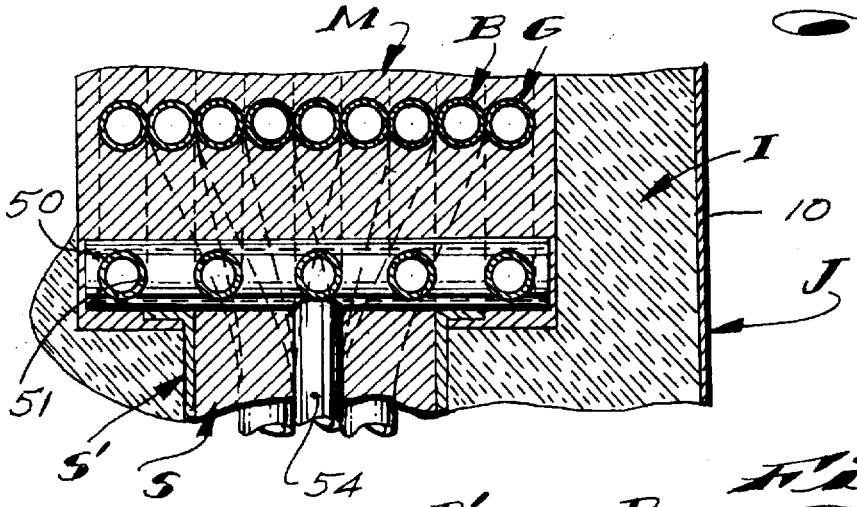
FIG. 4 is a sectional view taken substantially as indicated by line 4—4 on FIG. 2.
Figure 5:
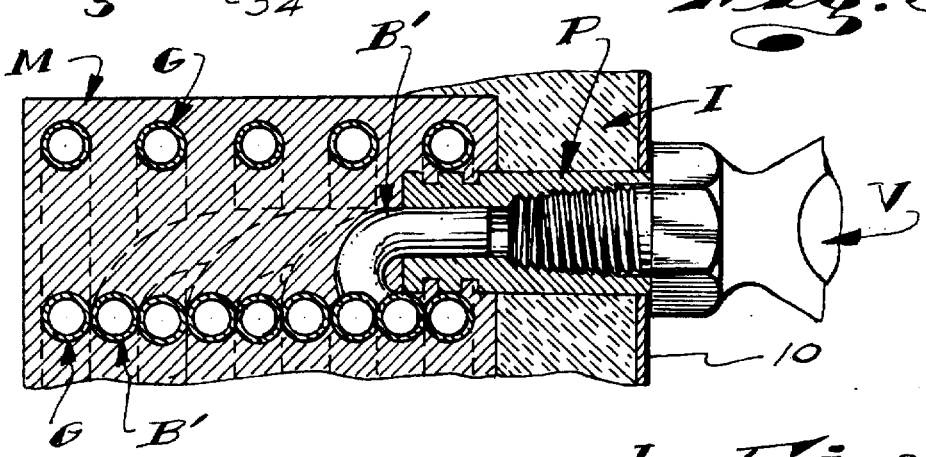
FIG. 5 is a sectional view taken substantially as indicated by line 5—5 on FIG. 2.

The glycol coil unit G next include elongate tubular glycol inlet and outlet tube sections 54 and 55 with downstream ends connected with the upstream and downstream manifolds and that extend parallel with the upstream end portions of the beer coils B through the stem S, as clearly shown in FIGS. 2, 3, and 4 of the drawings. The lower terminal end portions of the tubes 54 and 55 depend from the stem and connect with the upstream and downstream sections of an elongate plastic glycol recirculating lines of a related glycol chiller.

The tube stock of which the coils 53 and sections 54 and 55 of the unit G established is 5/16' ID tubing.

With the above relationship of parts the rate of flow of the glycol through the plate is reduced to 1/5 the rate of flow of glycol through the glycol lines and the heat transfer surface area for the glycol, within the plate, is increased 5 times. Thus the glycol is let to function efficiently to absorb and carry heat from the plate.

The tower structure next includes fastener means F to releasably fasten the tower atop the counter C.

Figure 6:
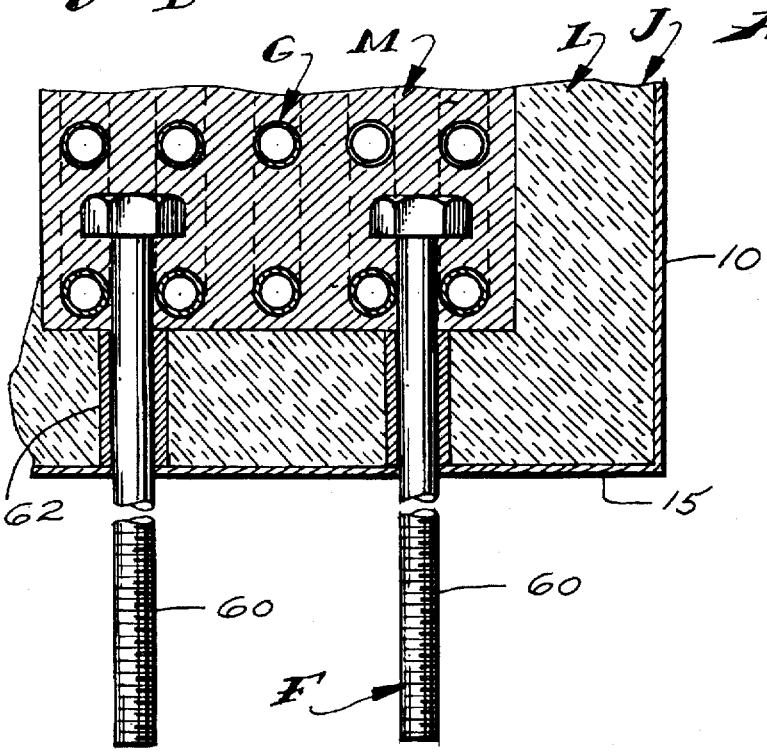
FIG. 6 is a sectional view taken substantially as indicated by line 6—6 on FIG. 2.

In one embodiment of the invention and as illustrated in FIGS. 2 and 6 of the drawings, the fastener means F includes a plurality of vertically extending bolt 60 with upper head portions set and anchored within the plate and lower threaded portions that depend from the plate, through the jacket structure J and downwardly through fastener receiving openings 61 in the counter. The stud 60 depend below the bottom surface of the counter.

The means F next include compression sleeves 62 about the portions of the bolts that extend between the bottom surface 15' of the plate and the bottom wall 15 of the jacket structure J.

The means F next includes screw fastener parts such as nuts 63 engaged on the lower portions of the studs and advanced upwardly therean to engage the bottom surface of the counter and to draw the tower down with its bottom wall 15 in secure, stable engagement with the top of the counter. In accordance with common practices, load distributing washers 64 are preferably engaged about the studs, between the counter and the nuts.

In the case illustrated 4 bolts or studs 60 are provided and are suitably spaced apart so that the tower structure is effectively and stably mounted atop the counter and is not subject to being displaced or adversely worked when put to its intended use.

A serious short-coming presented by the means F described above resides in the fact that the bolts conduct heat to the plate and reduce its efficiency. Further, the bolts are chilled by the plate and their lower portions, which are exposed to atmosphere below the counter act as condensers on and about which water condenses and from which that water is likely to co continuously drip. When the atmosphere is quit humid, as much as one cup of water might condense on and drop from each bolt, each hour. The condensation of water on or about the studs might be notably reduced by packing insulation material about them.

Figure 9:
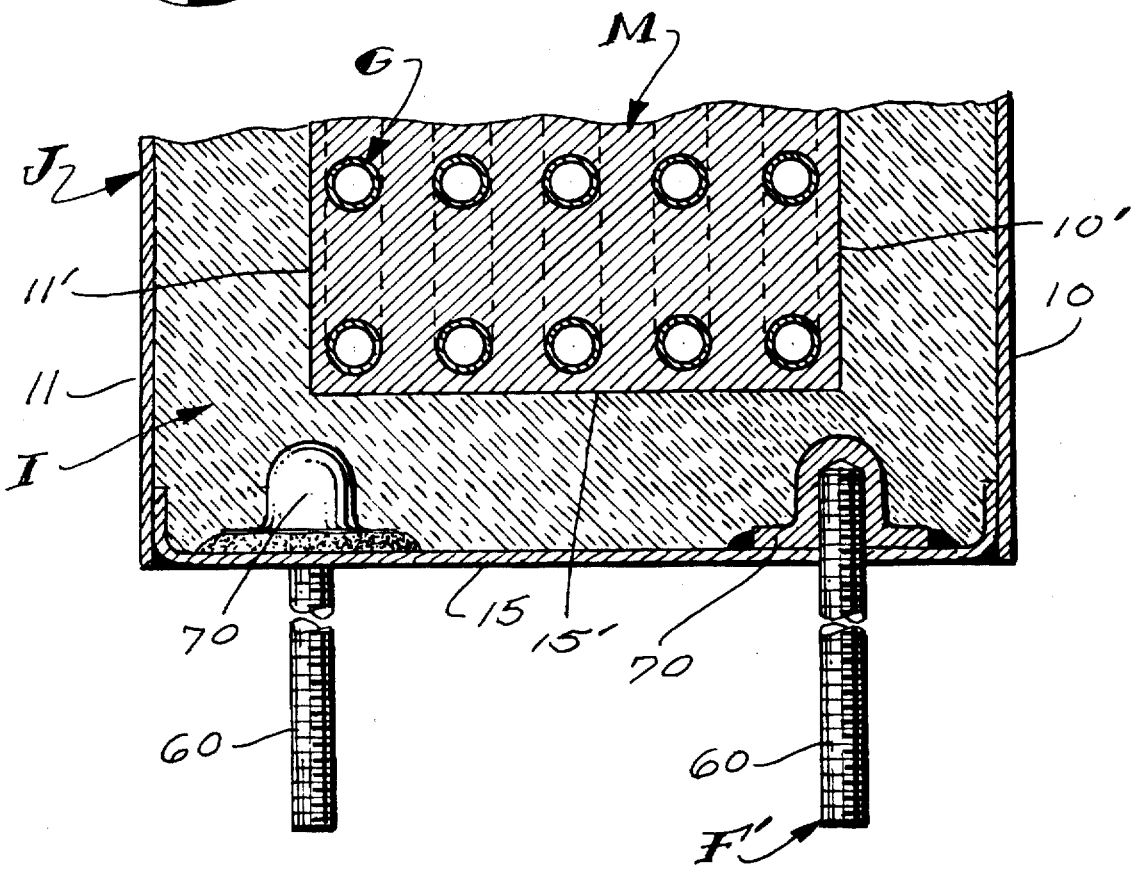

In FIG. 9 of the drawings we have illustrated a second and preferred form of fastening means F'. The means F' includes ranged weld nuts 70 welded to the top surface of the bottom wall 15 of the jacket structure J in alignment with openings formed in that wall. The nuts 70 project upwardly into the insulating material I and are separate from the plate M. The studs 60 are all-thread studs having upper ends engaged in and carried by the nuts 70. With this form of fastener means the studs are thermally insulated from the plate and neither adversely affect the efficiency of the plate or become chilled to act as condensers.

The fastener means F' is particularly suitable for use in those tower structure in which the insulating material I of the jacket structure is structurally strong, stable hard foam insulation that renders the lower portion of the tower structure sufficiently strong and stable so that the tower structure, as a whole, is effectively stably supported.

The valves V of the tower structure can be any one of a plurality of commercially available beer dispensing valves with standard threaded connecting nipples or stems.

In the event that valves with other then standard threaded mounting stems are to be used, the valve mounting parts P, illustrated in the drawings can be replaced with other suitably formed mounting parts without departing from the broader aspects and spirit of our invention.

In practice when the tower structure is put to its intended use and glycol chilled below 30° F. is circulated through the tower it has been observed that the bodies of the valves V, which are made of metal, are chilled to an extent that condensation quickly forms about then and freezes to establish coatings of ice of substantial thickness. Accordingly the valves are chilled to below 32° F. and no appreciable heating of beer flowing through or resting in them is likely to occur. As a result, when beer is dispensed through and from the valves B the gas therein is not thermally excited and does not tend to separate and blast beer out of the valves. The ice that forms about the valves is itself sufficiently good thermal insulation so that the thermal efficiency of the tower is in and enhanced thereby.

When a beer dispensing valve is opened pressure on the beer, downstream of the valve drops abruptly. The drop in pressure causes gas in the beer to expand and to become unstable. The unstable gas is subject to escaping from the beer liquor. If the foregoing is not corrected or compensated for, when the valve is opened, the gas will blast out of the valve and a considerable portion of beer first dispensed from the valve will be in the form of foam. To compensate of correct the above problem the prior art has long established the beer delivery tubes in tower structures of tubing that is smaller in inside diameter than the inside diameter of related plastic beer delivery lines or the beer conducting coils in related cold plates. For example, when the lines and coils are 5/16" ID the delivery tubes are made of tubing of 1/4" ID. In addition to the foregoing, the prior art connects the 1/4" ID delivery tubes with the 5/16" beer lines or coils with lengths of 1/4" ID plastic tubing. Those lengths of tubing are referred to or called balance lines. The balance lines are often between 8 and 12 feet long and are such that they must be coiled or otherwise gathered up and stuffed or tucked away and packed with thermo insulating material as effectively as circumstances permit.

The balance lines of the prior an are seldom affectively thermally insulated and allow for substantial warming of the beer that flows through them. That warming of the beer causes the gas entrained in the beer to expand and become unstable, increasing the tendency of the gas to escape from the beer.

The above noted 1/4" balance lines function to cause the drop in pressure on the beer that occurs when the related valves are opened to be manifested downstream of the balance line in the larger in diameter 5/16" beer lines or coils. Accordingly, if the drop in pressure results in gas separating from the beer, it separates downstream of the balance lines. The balance lines are of sufficient longitudinal extent to allow the gas that has escaped from the beer to be reabsorbed by the beer as it moves downstream through the balanced lines to the valves.

The length of the balance lines must be sufficiently great so that despite warming of the beer and de-stabilizing of the gas entrained therein, the free gases will be reabsorbed by the liquor of the beer before the beer reaches the valves.

In the present invention the downstream end portions B' of the beer coils, within the plate, are reduced in from 5/16" ID to 1/4" ID. The reduced in diameter end portions B' of the beer coils need not be more than 6 feet long. The portions B' of the coils serve the same function that the balance lines provided by the prior art serve.

The notable advantage that we have gained by reducing the size of the downstream end portions of the beer coils to serve the end that prior art balanced lines serve resides in the fact that the sections B' of the coils are an integral part of the cold plate structure and do not allow for warming of beer flowing through them and can be made substantially shorter then conventional balance lines. The sections B' of the beer coils in the present tower structure eliminate the need to provide, install, stow away and insulate separate balance lines, as is common practice in these systems and apparatus for dispensing beer that the prior art provides.

Figure 8:
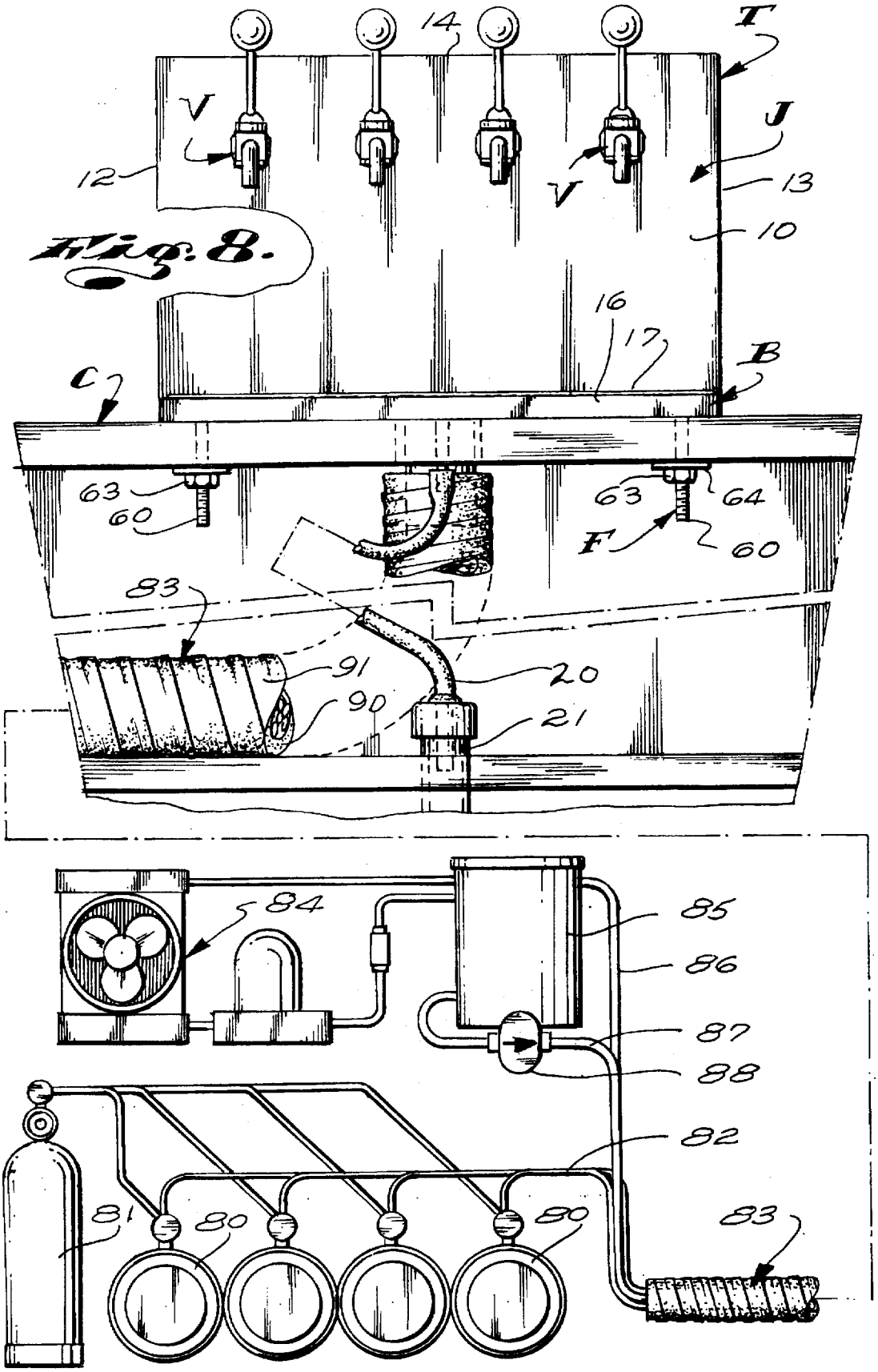
FIG. 8 is a diagrammatic view showing the power structure related to parts of a complete beer dispensing system; and, FIG. 9 is a sectional view showing another and preferred stud mounting means.

In FIG. 8 of the drawings the tower structure T is shown installed atop a counter C and connected with and made a part of a beer dispensing system that includes 4 kegs of beer 80 a supply of compressed motive gas 81 suitably connected with the kegs and beer delivery lines 82 extending from the kegs to the upstream end of and these ? an elongate trunk line 83. The system next includes a refrigerated glycol chiller 84 including a heat transfer tank 85, a motor driven glycol recirculating pump 86, and a glycol recirculating line with delivery section 87 connected with the pump 86 and entering the upstream end of the trunk line 83 and a return section 88 connected with the tank 85 and entering up and extend through the trunk line 83. All of the above noted parts of the system are positioned within a refrigerated cold room (not shown) where a mean temperature of about 40° F. is maintained. The glycol chiller 84 operates to chill anti-freeze glycol solution to for example 30° F. and continuously recirculates the glycol through the tank 85 and the section 87 and 88 of the glycol line.

The trunk line 83 through which the lines 82, 85, and 87 extend exits the cold room and is of sufficient length and is so arranged that its downstream end terminates beneath the counter C where the tower T is mounted. The downstream end of the trunk line is preferably turned upwardly and into alignment with the stem S. The downstream ends of the beer lines 82, the downstream end of the section 87 of the glycol line and the upstream end of the section 88 of the glycol line are aligned with and are suitably connected with the ends of their related beer and glycol coils that depend from the stem 10.

The glycol circulated through the stem and the plate M absorbs and carry heat away from the plate, the valve mounting parts, the valves, the beer coils and the beer flowing through the beer coils. In the example given the beer in the beer coils and the bodies of the valves V will be chilled to and remain at 30° F.

By controlling and adjusting the temperature and the volume and the rate of flow of glycol through the plate the effectiveness and or capacity of the tower to chill and dispense beer at a desired low temperature can be adjusted so that beer can be caused to flow through and from the tower substantially continuously without any appreciable deviation in temperature.

But for the tower structure T the system shown in figure eight of the drawings is a typical beer dispensing system provided by the prior art and is illustrative one such system with which our new tower structure can be advantageously related to and incorporated in.

Figure 7:
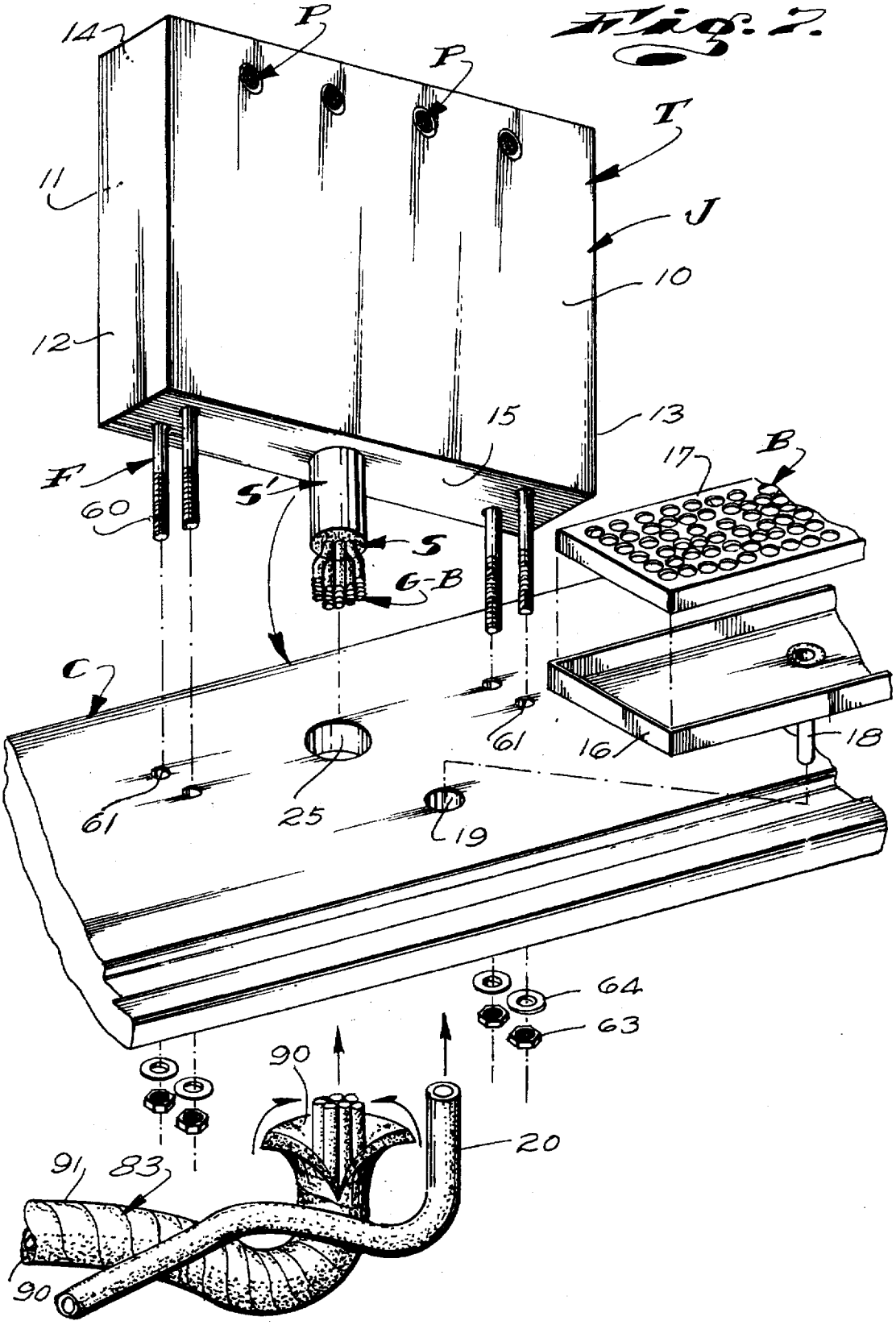
FIG. 7 is an exploded view of parts of the tower structure.

Referring to FIG. 7 of the drawings, to install our new tower structure T atop a counter C, a single vertical primary hole or opening 25 of sufficient diameter to accommodate the stem S and four vertical secondary holes or openings 61 of sufficient diameter to accommodate the studs 60 are drilled in the counter. A template is preferably provided to facilitate proper location of the holes.

With the five above noted holes established in the counter, the tower structure is manually positioned above the counter and is lowered to direct the stem and the studs through the openings and to move the bottom wall 15 of the tower into stop-supported engagement with the top surface of the counter. In practice, a bead of silicone sealant is deposited between the peripheral portion of the bottom wall and the counter top.

With the tower in position, as noted above, the nuts 63 (with their related washers 64) are engaged with an advanced on the studs to draw and secure the tower downwardly and into tight, sound and secure engagement with the counter.

Thereafter, the beer and glycol lines, at the downstream end of the trunk line are engaged and secured to their related ends of the beer coils and glycol coils unit.

In practice, the trunk line 83 includes a tubular body 90 of flexible, thermo insulating foam plastic through which the beer and glycol extends. The tubular body 90 of insulating material is usually established of two opposing U-shaped in cross sectioned parts that are held in closed opposed relationship with each other and about the lines extending therethrough by a tape wrapper 91.

In the preferred embodiment of our invention the downstream end portion of the tubular body 90 of insulating material is split and the ends of the lines extending there through are cut short of that end of the insulating body a sufficient distance so that when the several lines of the trunk line are connected with their related coils and coil unit the end portion of the body 90 of insulating material can be moved into engaged about the stem S of the tower and re-taped so as to effectively insulate the stem.

After the tower is installed as noted above, the valves V are simply manually screwed into their related parts P of the tower structure.

It will apparent from the above that the tower T of the present invention is an easy and economical to make structure and is such that it can be installed and connected with related parts of an existing or new counter structure and beer dispensing system with the expenditure of little time and without the exercises of any special skills.

It is to be particularly noted that the tower structure of the present invention can be advantageously made to accommodate two or three dispensing valves for dispensing two or three brands of beer or can be made to accommodate any other number of valves for dispensing beer without in any way department from the broader aspects and spirit of our invention.

It is to be noted that the counter space that the tower occupies is notably less then the counter space that would have to be sacrificed to accommodate four separate prior art beer dispensing tower structures in accordance with old practices. Another notable advantage afforded by the present invention resides in the fact that only five openings need be formed in the counter top to accommodate the tower structure and that the lower ends of the studs and the lower end of the stem that extend through and depend from the bottom of the counter occupy an insignificant amount of space beneath the counter.

With our new tower structure, those instances where cabinetry beneath a counter with which our tower is related might have to be worked upon or modified to accommodate our tower structure, are rare.

Having described only typical preferred forms and embodiments of our invention we do not wish to be limited to the specific details herein set forth but wish to reserve to ourselves any modifications and or variations that might appear to those skilled in the art and that all within the scope of the following claims.

Having described our invention, we claim:

1. A counter top beer dispensing tower structure including an elongate extending thermo insulating jacket structure with front, rear, side, and top walls and a counter top engaging bottom wall and a body of thermo insulating material about interior surfaces of the walls; a cast metal plate with front, rear, side, top and bottom surfaces spaced inward from the front, rear, side, top and bottom walls and within the body of insulating material, a multiplicity of elongate metal beer conducting and dispensing valve mounting parts, for mounting a beer dispensing valve in direct thermal conductive relationship with the plate, inner end portions anchored within the plate and outer end portions projecting through the jacket structure and accessible at openings in the front wall, a multiplicity of a elongate tubular beer coils within the plate and each having a downstream end portion connected with a related mounting part and a vertical upstream end portion depending from the bottom surface of the plate and through the jacket structure and a related counter top, a glycol recirculating coil unit within the plate and having vertical upstream and downstream tubular end portions depending from the bottom surface of the plate and through the jacket structure and related counter top a refrigerated glycol chiller machine connected with the glycol recirculating coil unit and; a plurality of elongate vertical threaded mounting studs with upper ends anchored in the tower structure and depending therefrom for engagement through openings in the related counter top.

2. The tower structure set forth in claim 1 wherein the plate is made of cast aluminum alloy, the mounting parts, beer coils and glycol coil unit are made of stainless steel tubing, the walls of the jacket structure and the studs are made of metal and the body of insulating material is made of non-interconnected connected cellular foam plastic.

3. The tower structure set forth in claim 1 wherein the vertical downstream end portions of the beer coils and vertical upstream and downstream end portions of the glycol coil unit are in substantial parallel Juxtaposition position and extend through and from the lower end of an elongate vertical stem formed integrally with and depending from the bottom surface of the plate and through the jacket structure.

4. The tower structure set forth in claim 1 wherein the front wall of the jacket structure is a substantially flat, vertical and laterally extending wall with laterally spaced valve mounting part recurring openings in its upper portion, the outer portion of each valve mounting part projects forwardly from the plate through the body of insulating material and terminates at a related valve mounting part opening.

5. The tower structure set forth in claim 1 wherein the upper ends of the mounting studs are anchored within the plate and depend therefrom through and from the jacket structure.

6. The tower structure set forth in claim 1 wherein the upper ends of the mounting studs are anchored to and depend from the bottom wall of the jacket structure.

7. The tower structure set forth in claim 1 wherein the plate is made of cast aluminum alloy, the valve mounting parts, beer coils and glycol coil unit are made of stainless steel, the walls of the jacket structure and the studs are made of metal and the body of insulating material is made of non-interconnected connected cellular foam plastic; the vertical upstream end portions of the beer coils and vertical upstream and downstream end portions of the glycol coil unit are in parallel juxtaposition and extend through and from the lower end of an elongate vertical stem that is formed integrally with and depends from the bottom surface of the plate and through the jacket structure.

8. The tower structure set forth in claim 1 wherein the plate is made of cast aluminum alloy, the valve mounting parts, beer coils and glycol coil unit are made of stainless steel, the walls of the jacket structure and the studs are made of metal and the body of insulating material is made of non-interconnected connected cellular foam plastic; the front wall of the jacket structure is a substantially flat vertically and laterally extending wall with laterally spaced valve mounting parts openings in its upper portion, the outer portion of the dispensing valve mounting parts project forwardly from the plate, thorough the body of insulating material and terminates at related valve mounting part opening in the front wall.

9. The tower structure set forth in claim 1 wherein the plate is made of cast aluminum alloy, the dispensing valve mounting parts, beer coils and glycol coil unit are made of stainless steel, the walls of the jacket structure and the studs are made of metal and the body of insulating material is made of non-interconnected connected cellular foam plastic; the upper end of the mounting studs are anchored within the plate and depend therefrom through and from the jacket structure.

10. The tower structure set forth in claim 1 wherein the plate is made of cast aluminum alloy, the dispensing valve mounting parts, beer coils and glycol coil unit are made of stainless steel, the walls of the jacket structure and the studs are made of metal and the body of insulating material is made of non-interconnected connected cellular foam plastic; the upper ends of the mounting studs are anchored to and depend from the bottom wall of the jacket structure.

11. The tower structure set forth in claim 1 wherein the plate is made of cast aluminum alloy, the dispensing valve mounting parts, beer coils and glycol coil unit are made of stainless steel, the walls of the jacket structure and the studs are made of metal and the body of insulating material is made of non-interconnected connected cellular foam plastic; the vertical upstream end portions of the beer coils and vertical upstream and downstream end portions of the glycol coil unit are in substantial parallel juxtaposition and extend through and from the lower end of an elongate vertical stem formed integrety with and that depends from the bottom surface of the plate and through and from the jacket structure; the front of the wall of the jacket structure is a substantially flat vertically and laterally extending wall with laterally spaced valve parts mounting openings in its upper portion, the outer portion of each valve mounting part projects forwardly from the plate through the body of insulating material and terminates at a related valve mounting part opening.

12. The tower structure set forth in claim 1 wherein the plate is made of cast aluminum alloy, the dispensing valve mounting parts, beer coils and glycol coil unit are made of stainless steel, the walls of the jacket structure and the studs are made of metal and the body of insulating material is made of non-interconnected connected cellular foam plastic; the vertical upstream end portions of the beer coils and the vertical upstream and downstream end portions of the glycol coil unit are in substantial parallel juxtaposition and extend through and from the lower end of an elongate vertical stem formed integrally with and that depends from the bottom surface of the plate and through and from the jacket structure; the front of the jacket structure is a substantially flat vertically and laterally extending wall with laterally spaced valve parts mounting openings in its upper portion, the outer portion of each valve mounting part projects forwardly from the plate through the body of insulating material and terminates at a related valve mounting part opening; the upper ends of the mounting studs are anchored within the plate and depend therefrom through and from the jacket structure.

13. The tower structure set forth in claim 1 wherein the plate is made of cast aluminum alloy, the dispensing valve mounting parts, beer coils and glycol coil unit are made of stainless steel, the walls of the jacket structure and the studs are made of metal and the body of insulating material is made of non-interconnected connected cellular foam plastic; the vertical downstream end portions of the beer coils and vertical upstream and downstream end portions of the glycol coil unit are in parallel justable position and extend through and from the lower end of an elongate vertical stem formed integral with and that depends from the bottom surface of the plate and through and from the jacket structure; the front of the wall of the jacket structure is a substantially flat vertically and laterally extending wall with laterally spaced valve parts mounting openings in its upper portion, the outer portion of each valve mounting part projects forwardly from the plate through the body of insulating material and terminates at a related valve mounting part opening; the upper ends of the mounting studs are anchored to and depend from the bottom wall of the jacket structure.

14. The tower structure set forth in claim 1 wherein portions of the beer coils between the upstream and downstream and portions thereof are of sinuate form and extend throughout the plate, the glycol unit includes upstream and downstream manifolds within the plate and with which the upstream and downstream end portions of the unit are connected and a multiplicity of sinuate formed portions within the plate in substantial parallel relationship with the sinuate formed portions of the beer coils and connected with and between the manifolds.

15. In combination, a beer dispensing apparatus including kegs of beer in a chilled storage space, and elevated beer dispensing counter with top and bottom surfaces spaced form the kegs and storage space, an elongate tubular trunk line with upstream and downstream ends and including an outer body of thermo insulating material and extending from the kegs and storage space to below the counter, a plurality of elongate beer conducting beer lines extending longitudinally through the trunk line and having upstream end portions connected with the kegs and downstream end portions accessible at the downstream end of the trunk line and a glycol chiller means including a refrigerated glycol heat exchanger at the upstream end of the trunk line and a glycol line extending through the trunk line and having an upstream end connected with the glycol heat exchanger and a downstream end accessible at the downstream end of the trunk line and return section extending through the trunk line and having an upstream end accessible at the downstream end of the trunk line and a downstream end connected with the glycol heat exchanger, a recirculating pump connected with and between the heat exchanger and one of the glycol line section a beer dispensing tower structure mounted on the top of and projecting upwardly from the counter and including an outer thermally insulating jacket structure, a metal heat exchanging cold plate within the jacket structure, a plurality of elongate beer conducting valve mounting parts with inner ends within the plate and outer ends extending through the jacket structure and accessible at the exterior thereof, a manually operable beer dispensing valve engaged with and projecting outwardly from the outer end of each mounting part, a plurality sinuate formed tubular beer conducting coils within the plate and each having a downstream end portion connected with a related valve mounting part and a vertical upstream end portion depending from the plate through the jacket structure and through a primary opening in the counter to terminate below the counter where it is connected with the downstream end of a related beer line, a glycol coil unit within the plate with sinuate portions extending substantially parallel with the beer coils and vertical upstream and downstream end portions depending from the plate and jacket structure and through the primary opening in the counter to terminate below the counter where they connect with the delivering return sections of the glycol lines; a plurality of spaced apart elongate vertical threaded studs with upper ends anchored in the tower structure and depending therefrom through secondary openings in the counter; and, nuts engaged on the lower end portions of the studs and advanced upwardly thereon into engagement with the bottom of the counter and drawing the tower structure down into tight secure engagement with the top of the counter.

16. The combination set forth in claim 15 wherein the tubular body of insulating material of the trunk line is engaged about the portions of the coils that depend from the tower through and below the primary opening in the counter.

17. The combination set forth in claim 15 wherein the end portions of the coils depending from the plate extend longitudinally thorough and downwardly from an elongate vertically extending metal stem formed interaly with the plate and that depend therefrom through the primary opening in the counter.

18. The combination set forth in claim 15 wherein the end portions of the coils depending from the plate extend longitudinally thorough and downwardly from an elongate vertically extending metal stem formed integrally with the plate and that depend therefrom through the primary opening in the counter, a tubular body of insulating material of the is engaged about the stem.

* * * * *